United States Patent [19]

Baffo

[11] 3,978,966

[45] Sept. 7, 1976

[54] TABULATION OPERATION SENSING UNIT FOR AUTOMATIC TYPEWRITER

[75] Inventor: Mariano Baffo, Woburn, Mass.

[73] Assignee: Ty-Data, Inc., Nashua

[22] Filed: June 4, 1975

[21] Appl. No.: 583,668

[52] U.S. Cl. ..... 197/176; 403/356

[51] Int. Cl.[2] ..... B41J 21/00

[58] Field of Search ..... 64/1 R; 74/67, 116; 197/107, 108, 176–179; 235/27; 403/356

[56] References Cited

UNITED STATES PATENTS

| | | | |
|---|---|---|---|
| 349,365 | 9/1886 | Roots | 403/356 X |
| 1,446,652 | 2/1923 | Morris | 403/356 X |
| 3,006,198 | 10/1961 | Cohen et al. | 74/67 |
| 3,097,006 | 7/1963 | Logue | 403/356 X |

*Primary Examiner*—Edgar S. Burr
*Assistant Examiner*—Paul T. Sewell
*Attorney, Agent, or Firm*—Cesari and McKenna

[57] ABSTRACT

A unit for sensing a tabulation operation in an automatic typewriter. An interconnecting member is disposed between a typewriter mainspring and a fluid clutch. This member has a disk portion nested in a hole formed in a mainspring housing. An eccentric pin portion extends axially from the disk portion and engages the mainspring while a counter-extending shaft portion engages a drive shaft from the fluid clutch. When the mainspring unwinds during a tabulation operation, it rotates the interconnecting member and drive shaft to displace an outer housing arm on the fluid clutch and close a switch thereby to indicate the occurrence of the tabulation operation.

1 Claim, 1 Drawing Figure

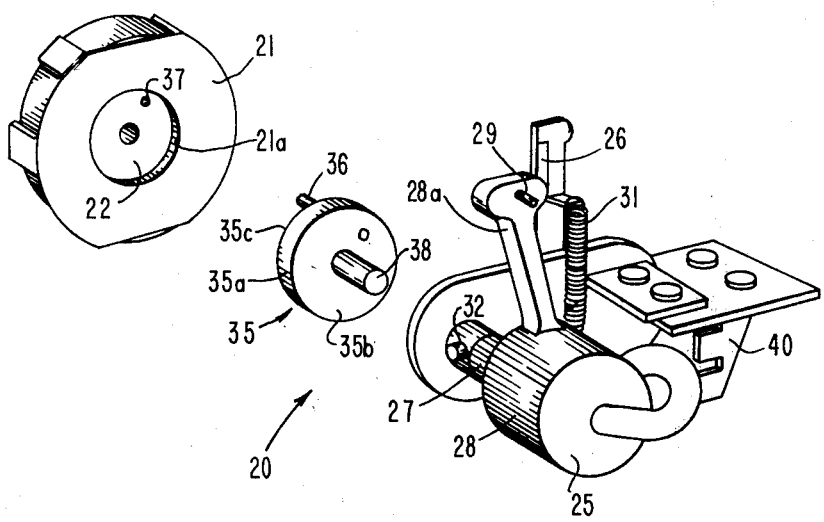
21
37
21a
22
36
35c
38
35a
35
35b
20
29
26
28a
31
32
40
27
28
25

TABULATION OPERATION SENSING UNIT FOR AUTOMATIC TYPEWRITER

CROSS-REFERENCE TO A RELATED APPLICATION

This application incorporates subject matter which is also disclosed in a copending application Ser. No. 583,678 (File No. H90-001) filed by William F. Brine, Jr. and Mariano Baffo concurrently herewith, entitled "Automatic Typewriter" and assigned to the same assignee as the present invention.

BACKGROUND OF THE INVENTION

This invention generally relates to automatic typewriters and, more particularly, to a unit for sensing tabulation operations in such automatic typewriters.

Automatic typewriters are used in automated typing, computer, message transfer and other systems and applications. In such systems, these typewriters perform a data input and transmitting function and a signal receiving and data output function. During the first function an operator strikes the typewriter keys simultaneously to type on that typewriter, and, by means of various sensors, to transfer to signal processing equipment signals representing the typing operations being performed. In an automated typing system, this equipment comprises circuits for transferring the signals to a storage medium; in a computer system, a computer or an input/output controller; and in a message transfer system, another automatic typewriter.

During the signal receiving and data output function, the signal processing equipment transfers character and timing signals to the automatic typewriter. Various actuators cause the typewriter to print in response to these received signals.

A number of such automatic typewriters have been and are now available. They have become more popular with the advent of code responsive, bail operated, electric typewriters. Such typewriters are marketed by IBM under the trademark "Selectric." These electric typewriters are sold both to offices for use as conventional electric typewriters and to other manufacturers for use as automatic typewriters in the foregoing and other applications.

One operation which all typewriters perform is a tabulation. Conventionally an operator strikes a tab key in a code responsive, bail operated typewriter to pivot a tab torque bar, and move backspace and escapement pawls out of racks. A tensioned mainspring then unwinds and, through a pulley network, moves a carrier until a tab lever contacts a tab stop. An automatic typewriter must also perform this operation in response to signals from the signal processing equipment. Moreover, the signal processing equipment must not transmit signals corresponding to subsequent operations until the tabulation operation is completed.

There are several possible ways to inhibit the transmission of such signals. For example, the signal processing equipment might delay the issue of any further signals for a fixed, instant interval corresponding to the maximum tabulation operation interval. As many such operations are only for a few spaces (e.g., the indentation of a paragraph) this constant delay after each tabulation operation can reduce the effective typing rate noticeably, especially where a line is typed after multiple tabulation operations.

There are two alternate procedures for sensing the actual time the tabulation operation occurs, which do improve overall typing speeds. In one a sensor, transmits signals in response to motion of the tab torque bar. However, the resulting signals are not very reliable because the tab torque bar undergoes damped oscillations at the beginning and end of each tabulation operation. The sensors can produce multiple signals during these oscillations and cause the signal processing equipment to respond erroneously.

In another unit, a fluid clutch connects to a shaft from the mainspring. During a tabulation operation, the shaft rotates an impeller in the fluid clutch and displaces a magnet, carried by an arm on the outer housing of the fluid clutch, into proximity with a magnetically operated switch thereby to close the switch. Although this sensing unit substantially eliminates the erroneous signals produced in the tab torque bar sensing unit, the conventional mainspring either must be replaced or must be modified because the conventional mainspring has no such mainspring shaft.

Therefore, it is an object of this invention to provide simplified tabulation sensing unit.

Another object of this invention is to provide a simplified fluid clutch tabulation sensing unit which utilizes a conventional mainspring.

Yet another object of this invention is to provide a tabulation sensing unit which is less expensive than prior units.

SUMMARY OF THE INVENTION

In accordance with this invention, an interconnecting member has a disk portion with oppositely extending eccentric, axially extending pin and axial shaft portions. When this member is disposed between the mainspring and the fluid clutch, the pin portion engages the conventional mainspring, and the shaft drives a fluid clutch. When a tabulation operation occurs, mainspring motion displaces an outer fluid clutch housing and, through a magnet mounted on a housing arm, closes a switch thereby to indicate the tabulation operation.

This invention is pointed out with particularity in the appended claims. The foregoing and other features and advantages of the invention will be better understood by referring to the following description taken in conjunction with the accompanying drawing.

BRIEF DESCRIPTION OF THE DRAWING

The sole FIGURE is an exploded, perspective view of a tabulation sensing unit constructed in accordance with the present invention.

DESCRIPTION OF AN ILLUSTRATIVE EMBODIMENT

The FIGURE illustrates an integral fluid clutch and reed switch for incorporation within an automatic typewriter utilizing a conventional, code responsive, bail actuated electric typewriter. The detailed structure and mode of operation of such typewriters are well known to those skilled in the art. Consequently, the detailed description that follows is limited to an explanation of a tabulation sensing unit of the present invention, its incorporation into the typewriter, and its operation and coaction with the various well-known parts of the typewriter. Although the preferred embodiment of the invention is described for incorporation within a modified "Selectric" typewriter described in the foregoing Baffo et al patent application, it will become apparent that this invention has application to other types and forms of automatic typewriters.

In the FIGURE, a sensing assembly 20 operates in conjunction with a typewriter mainspring assembly 21, which in the typewriter is exposed at the rear when the outer typewriter case is removed. As known, the mainspring unwinds to rotate a central hub 22 and, through a pulley arrangement, to move a carrier (not shown) to a new position. The mainspring 21 rewinds during each carrier return operation. Thus, a unit which senses the rotary motion of central hub 22 during a tabulation operation senses the time period during which the typewriter carrier is in motion during a tabulation operation.

A fluid clutch 25 and reed switch 26 sense the rotary motion of central hub 22. The fluid clutch 25 comprises a hollow shaft or hub 27 pivotally mounted in an outer housing or cannister 28 which is filled with a viscous fluid, such as a heavy oil. The shaft 27 rotates with central hub 22 of mainspring 21 and turns an impeller (not shown) in the fluid clutch 25. An arm 28*a* formed with the housing 28 carries a permanent magnet 29.

During any carrier advance operation, including a tabulation operation, the incremental motion of the hub 22 is sufficiently great to displace the housing 28 against the bias of a spring 31. When this occurs, the housing 28 and arm 28*a* rotate through a fixed arc to bring the permanent magnet 29 into juxtaposition with reed switch 26. Then the contacts of reed switch 26 close and transmit an electrical code signal which signifies that the typewriter carrier is undergoing a tabulation operation. This signal blocks any additional data transfers from the signal processing equipment (not shown). When the tabulation operation is completed, the spring 31 returns the housing 28 to its original position. Thus, when central hub 22 of mainspring 21 stops rotating (i.e., when the carrier has reached its new position), permanent magnet 29 moves away from reed switch 26, so the switch 26 opens and terminates the signal thereby to signify the end of the tabulation operation.

In accordance with my invention, I use an adapter 35 as an interconnecting element between the fluid clutch 25 and the conventional mainspring 21. The adapter 35 has a circular disk portion 35*a* with first and second major surfaces 35*c* and 35*b*. The disk portion 35*a* has a diameter slightly smaller than the diameter of a hole 21*a* in the housing of mainspring 21. The hole 21*a* also exposes the central hub 22 including a hole 37 formed by a curl at the end of the spring inside the housing. An eccentrically located, axial pin 36 extending from one side of the disk portion 35 fits in hole 37. A counter extending center shaft 38 fits in the shaft 27 of fluid clutch 25 and is secured therein by means of a set screw 32 or like fastener.

The member 35 is installed simply by inserting the pin 36 into the hole 37 before installing the fluid clutch 25. Then the shaft 27 of fluid clutch 25 slides over the shaft 38 and the set screw 32 is tightened to capture the member 35. An auxiliary bracket 40 which supports the fluid clutch 25 and reed switch 26 is secured to existing holes in the typewriter main frame.

Thus, my invention simplifies the construction of a tabulation sensing unit for indicating the interval during which a tabulation operation is in progress. Moreover, with my interconnecting member, the tabulation sensing unit connects to a conventional mainspring and requires no mainspring replacement or modification thereby reducing the costs of the unit. Although this invention has been described with respect to a specific embodiment, it will be apparent that various changes can be made without departing from this invention. Therefore, it is the object of the appended claims to cover all such variations and modifications as come within the true spirit and scope of this invention.

What I claim as new and desire to secure by Letters Patent of the United States is:

1. A tabulation sensing mechanism for use in an automatic typewriter of the type including tabulating means with a mainspring which unwinds during a tabulation operation, said mainspring including an outer housing, a central hub exposed through the outer housing which rotates when the mainspring unwinds and which includes an eccentrically located hole therein, said tabulation sensing mechanism comprising:

A. a fluid clutch including
   i. an outer housing containing a viscous fluid,
   ii. a fluid clutch shaft rotatably mounted in said fluid clutch housing and protruding therefrom, the end of said shaft protruding from said fluid clutch housing being hollow,
   iii. set screw means positioned on the hollow end of said shaft and tightenable into said shaft,
   iv. said fluid clutch housing being pivotal between first and second positions in response to rotation of said shaft;

B. switch means for generating an electrical signal in response to the pivotal movement of said fluid clutch housing from said first to said second position; and C. an interconnecting member for coupling the rotary motion of the mainspring hub to said fluid clutch shaft including
   i. a disk having first and second major surfaces,
   ii. an eccentric pin integral with said disk and extending axially from said first major surface for engaging the eccentrically located hole in the hub of said mainspring and to be rotated when the mainspring unwinds, and
   iii. a centrally located shaft integral with said disk and extending axially from said second major surface, said disk shaft being dimensioned to fit within the hollow end of said fluid clutch shaft and to be secured therein by said set screw means whereby said interconnecting member transfers the rotary motion of the mainspring to said fluid clutch shaft and the electrical signal generated by said switch means signifies that the typewriter is undergoing a tabulation operation.

* * * * *